US005784759A

United States Patent [19]

King

[11] Patent Number: 5,784,759

[45] Date of Patent: Jul. 28, 1998

[54] HINGE CONSTRUCTION

[76] Inventor: David Russell King, 61-67 Parramatta Road, Annandale, New South Wales 2038, Australia

[21] Appl. No.: 649,618

[22] PCT Filed: Oct. 31, 1994

[86] PCT No.: PCT/AU94/00669

§ 371 Date: Jul. 26, 1996

§ 102(e) Date: Jul. 26, 1996

[87] PCT Pub. No.: WO95/12735

PCT Pub. Date: May 11, 1995

[30] Foreign Application Priority Data

Nov. 2, 1993 [AU] Australia ..... PM2168

[51] Int. Cl.[6] ..... E05D 11/08

[52] U.S. Cl. ..... 16/342; 16/299; 16/307; 297/408

[58] Field of Search ..... 16/285, 290, 342, 16/338, 307, 304; 297/408

[56] References Cited

U.S. PATENT DOCUMENTS

| | | | |
|---|---|---|---|
| 4,193,631 | 3/1980 | Hobley et al. | 297/408 |
| 4,600,240 | 7/1986 | Suman et al. | 297/408 |
| 5,018,244 | 5/1991 | Hino | 16/342 |
| 5,028,913 | 7/1991 | Kitamura | 16/306 |
| 5,037,231 | 8/1991 | Kitamura | 16/307 |
| 5,173,837 | 12/1992 | Blackwell et al. | 16/342 |
| 5,197,704 | 3/1993 | Kitamura | 16/342 |
| 5,219,240 | 6/1993 | Kitamura | 16/305 |

FOREIGN PATENT DOCUMENTS

| | | |
|---|---|---|
| 63-23407 | 6/1994 | Japan . |
| 645918 | 6/1994 | Japan . |

*Primary Examiner*—Daniel W. Howell
*Assistant Examiner*—Mark Williams
*Attorney, Agent, or Firm*—Michael J. Striker

[57] ABSTRACT

A hinge construction has a fixed hinge member and a movable hinge member fixed to a mandrel, the mandrel being rotatably supported on the fixed hinge member, and a single coil spring one end of which is anchored immovably to the fixed hinge member the other end being free the coil spring closely surrounding the mandrel, an interior surface of the spring being in contact only with the mandrel, the arrangement being such that movement of the movable hinge member in one direction rotates the mandrel in a sense acting to uncoil the coil-spring thus allowing free movement of the movable hinge member whereas movement of the movable hinge member in the opposite direction acts to cause the coil-spring to tighten about the mandrel and thus resist movement.

4 Claims, 3 Drawing Sheets

HINGE CONSTRUCTION

BACKGROUND OF THE INVENTION

The present invention relates to a hinge construction intended for use in circumstances in which it is required that a movable hinge member shall be capable of relatively free movement in one direction of rotation while resisting movement in the other direction.

While there may well be many applications for such an arrangement, it finds a useful application in connecting a head rest for a chair back in a situation in which it is required to be able to set the head rest at any desired angle in relation to the back. Under these circumstances it is desirable that the head rest shall be capable of being hinged forwardly in relation to the back relatively easily to a position in which it makes a desired angle with the back but will resist the weight of a person sitting in the chair and leaning his head back against the head rest. However, the construction must be such as to permit the head rest to be hinged backwardly by the exertion of greater pressure.

SUMMARY OF THE INVENTION

Accordingly, it is an object of present invention to provide a hinge construction, which avoids the disadvantages of he prior art.

The present invention consists in a hinge construction comprising a fixed hinge member and a movable hinge member fixed to a mandrel the mandrel being rotatably supported on the fixed hinge member, and a coil-spring one end of which is anchored to the fixed hinge member the other end being free, the coil spring closely surrounding the mandrel, the arrangement being such that movement of the movable hinge member in one direction rotates the mandrel in a sense acting to uncoil the coil-spring thus allowing free movement of the movable hinge member whereas movement of the movable hinge member in the opposite direction acts to cause the coil-spring to tighten about the mandrel and thus resist movement.

The present invention in another aspect consists in a chair having a base, a back attached thereto and a head rest attached at the top of the back by means of two or more hinge constructions as defined in the last proceeding paragraph.

In order that the nature of the invention may be better understood a preferred form thereof is hereinafter described by way of example with reference to the accompanying drawings.

BRIEF DESCRIPTION OF PREFERRED EMBODIMENTS

DESCRIPTION OF PREFERRED EMBODIMENTS

Figure 1:
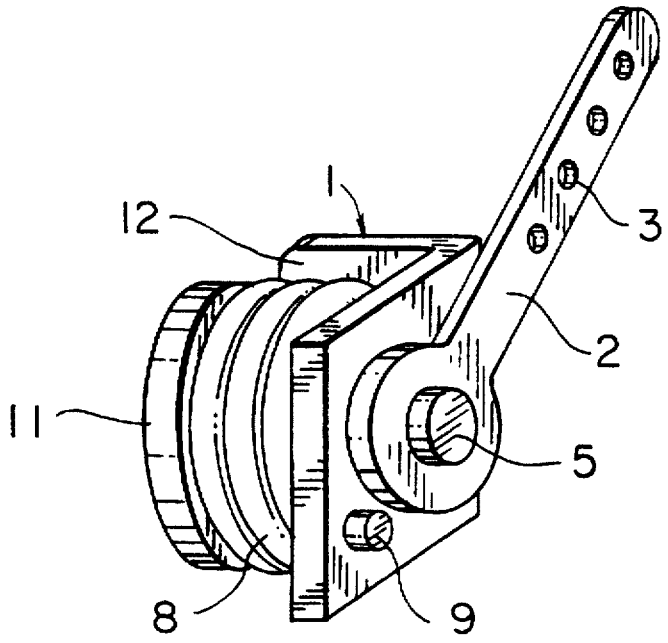
FIG. 1 is a perspective view of a hinge construction according to the invention.
Figure 2:
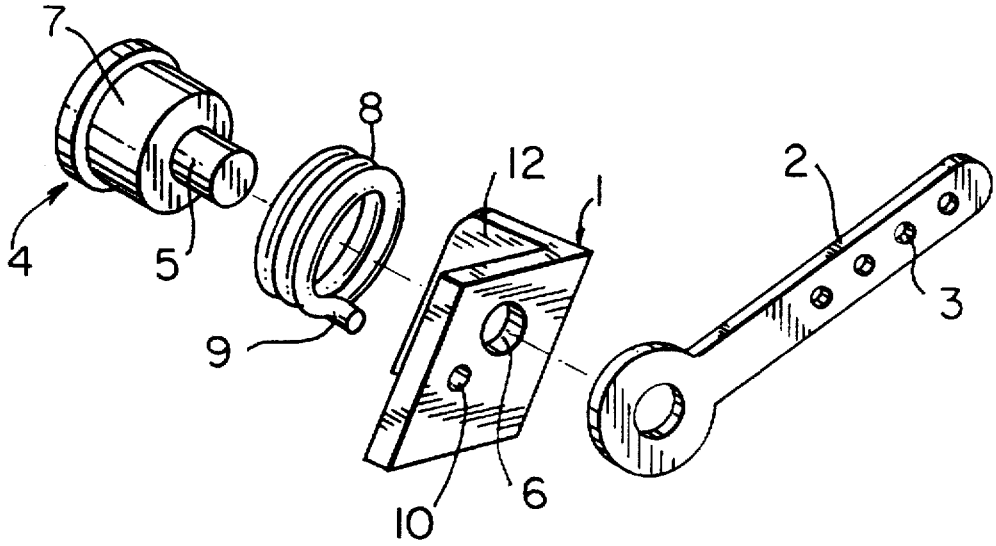
FIG. 2 is an exploded view showing the individual parts of the hinge construction.

The hinge construction illustrated in the drawings is intended for use in furniture as a means of, for example, attaching a head rest to the back of a chair or settee. It consists of a fixed hinge member 1 which is arranged for attachment to the back of the chair and a movable hinge member 2 having in it holes 3 by means of which it is attached to the head rest of the chair.

The movable hinge member 2 is welded to one end of a mandrel 4, one end 5 of which passes freely through the hole 6 in the fixed hinge member.

Around the central part 7 of the mandrel 4 a coil-spring 8 is wound so as to fit closely around the central part 1. One end 9 of the coil-spring is anchored in hole 10 in the fixed hinge member 1. The mandrel 4 is provided with an enlarged head 11 to hold the coil-spring 8 in place. The other end of the coil-spring B (not seen) is terminated close to the rear wall 12 of the fixed hinge member 1 and is free to move.

The arrangement is such that when the movable hinge member 2 is moved rearwardly in relation to the fixed hinge member 1 that is to say in a clockwise direction as seen when looking in the direction A of FIG. 1 friction between the central part 7 of the mandrel 4 and the coil-spring will cause the coil-spring to unwind thus permitting the movable hinge member to move freely. If on the other hand the movable hinge member 3 is moved in the other direction friction between the mandrel and the coil-spring will cause the coil-spring to wind more tightly around the mandrel gripping the mandrel and thus resisting movement.

It is, of course, essential that the clearance between the coil spring and the mandrel should be such that there is sufficient friction between them as to cause the spring to wind up about the mandrel when the moveable hinge member 3 is moved in the other direction. In practice this is readily ascertained by trial and error.

Figure 3:
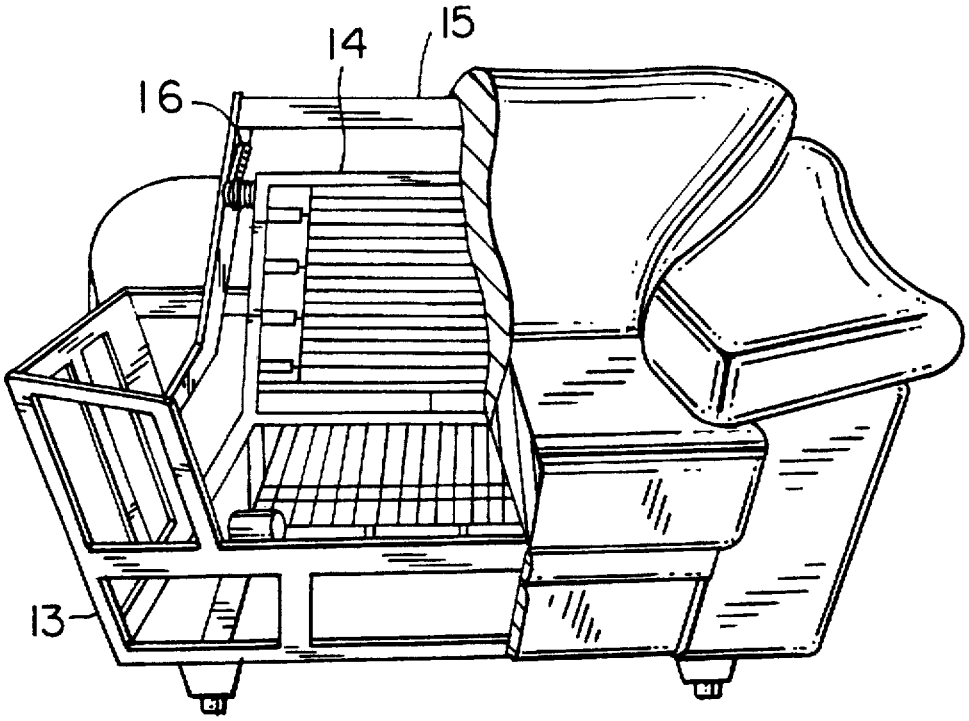
FIG. 3 is a front view of a chair having a back with a head rest hingedly connected to the back in accordance with the invention.

FIG. 3 is a front view of a seat the essential features of which as far as the present invention is concerned are the base 13, the fixed back 14 and the hinged head rest 15. The head rest 15 is hinged to the back by means of two hinge constructions 16 only one of which is seen in the drawing the hinge back construction being that shown in FIG. 1. Each hinge construction 16 is arranged to allow free movement of the head rest 15 in a forward direction while resisting movement in a rearward direction. This enables the head rest to be set at an angle to the back 14 convenient to the user. The resistance to movement of the hinge construction is such as to enable a user to lean his head back against the head rest 15. It is, however, so arranged that when pressure greater than that exerted normally by the user is applied the head rest may be pivoted rearwardly.

It will be appreciated by persons skilled in the art that numerous variations and/or modifications may be made to the invention as shown in the specific embodiments without departing from the spirit or scope of the invention as hereinafter defined. The present embodiments are, therefore, to be considered in all respects as illustrative and not restrictive.

I claim:

1. A hinge construction, comprising a fixed hinge member and a movable hinge member fixed to a mandrel, the mandrel having an enlarged head at one end and being rotatably supported on the fixed hinge member, and a single coil spring, one end of the coil spring is anchored immovably to the fixed hinge member, the other end being free, the coil spring closely surrounding the mandrel but being restrained from axial movement by the fixed hinge member at the one end and the enlarged head at the other, a interior surface of the spring being in contact only with the mandrel and over an entire length of the mandrel, such that movement of the movable hinge member in one direction rotates the mandrel in a sense acting to uncoil the coil-spring thus allowing free movement of the movable hinge member whereas movement of the movable hinge member in the opposite direction acts to cause the coil-spring to tighten about the mandrel and thus resist movement.

2. A hinge construction as claimed in claim 1 wherein one end of the mandrel passes through a hole in the fixed hinged member and is thereby rotatably supported and wherein the said one end of the coil spring is anchored by means of a portion passing through a hole in the fixed hinge member.

3. A chair, comprising a base, a back attached thereto, and a head rest attached at a top of the back by means of at least two hinge constructions, each of said hinge constructions including a fixed hinge member and a movable hinge member fixed to a mandrel, the mandrel having an enlarged head at one end and being rotatably supported on the fixed hinge member, and a single coil spring, one end of the coil spring is anchored immovably to the fixed hinge member, the other end being free, the coil spring closely surrounding the mandrel but being restrained from axial movement by the fixed hinged member at one end and the enlarged head at the other, a interior surface of the spring being in contact only with the mandrel and over an entire length of the mandrel such that movement of the movable hinge member in one direction rotates the mandrel in a sense acting to uncoil the coil-spring thus allowing free movement of the movable hinge member whereas movement of the movable hinge member in the opposite direction acts to cause the coil-spring to tighten about the mandrel and thus resist movement.

4. A chair having a base, a back attached thereto and a head rest attached at a top of the back by means of at least two hinge constructions, each of said hinge constructions including a fixed hinge member and a movable hinge member fixed to a mandrel, the mandrel having an enlarged head at one end and being rotatably supported on the fixed hinge member, and a single coil spring, one end of the coil spring is anchored immovably to the fixed hinge member, the other end being free, the coil spring closely surrounding the mandrel but being restrained from axial movement by the fixed hinged member at one end and the enlarged head at the other, a interior surface of the spring being in contact only with the mandrel and over an entire length of the mandrel, one end of the mandrel passes through a hole in the fixed hinge member and is thereby rotatably supported and wherein the said one end of the coil spring is anchored by means of a portion passing through a hole in the fixed hinge member, such that movement of the movable hinge member in one direction rotates the mandrel in a sense acting to uncoil the coil-spring thus allowing free movement of the movable hinge member whereas movement of the movable hinge member in the opposite direction acts to cause the coil-spring to tighten about the mandrel and thus resist movement.

* * * * *